US006729083B1

(12) United States Patent
Soyko

(10) Patent No.: US 6,729,083 B1
(45) Date of Patent: May 4, 2004

(54) ADJUSTABLE ROOF SUPPORT FRAME

(75) Inventor: Jay Soyko, Scottsdale, AZ (US)

(73) Assignee: Jaco Arf, LLC, Tempe, AZ (US)

( * ) Notice: Subject to any disclaimer, the term of this patent is extended or adjusted under 35 U.S.C. 154(b) by 0 days.

(21) Appl. No.: 10/388,272

(22) Filed: Mar. 12, 2003

(51) Int. Cl.[7] ..... E04C 2/52

(52) U.S. Cl. ..... 52/220.8; 52/646; 248/298.1; 248/906

(58) Field of Search ..... 52/220.8, 646; 248/216.1, 298.1, 316.8, 906

(56) References Cited

U.S. PATENT DOCUMENTS

| | | | | | |
|---|---|---|---|---|---|
| 752,869 | A | | 2/1904 | Smith | |
| 1,756,361 | A | * | 4/1930 | Johnson | 248/906 |
| 2,276,139 | A | | 3/1942 | Anderson et al. | |
| 2,661,677 | A | * | 12/1953 | Lingelbach | 248/906 |
| 2,990,920 | A | | 7/1961 | Hoffman, Jr. | |
| 3,451,153 | A | | 6/1969 | Dohanyos | |
| 4,660,799 | A | | 4/1987 | Butland | |
| 5,044,582 | A | | 9/1991 | Walters | |
| 5,313,759 | A | | 5/1994 | Chase, III | |
| 5,346,036 | A | | 9/1994 | Arisman et al. | |
| 5,516,068 | A | * | 5/1996 | Rice | 248/300 |
| 5,647,175 | A | | 7/1997 | Smyth | |
| 5,735,100 | A | | 4/1998 | Campbell | |
| 6,123,154 | A | * | 9/2000 | MacDonald et al. | 52/506.06 |
| 6,341,466 | B1 | * | 1/2002 | Kehoe et al. | 52/39 |

* cited by examiner

*Primary Examiner*—Peter R. Brown
(74) *Attorney, Agent, or Firm*—Schmeiser, Olsen & Watts LLP

(57) ABSTRACT

An adjustable roof support frame is disclosed. This support frame is adapted to support roofs with access holes. The support frame comprises two lateral supports and two cross supports. Preferably, all supports comprise a first and second member, the first member having a substantially C-shaped cross section that is adapted to slidably receive the second member. Fastening holes are provided on each member for receiving fasteners and attaching the two members together. Hook members are provided for attaching the ends of the lateral supports to trusses and L-brackets are used to attach the cross supports to the lateral supports. A truss bridge member is also provided for spanning a truss and attaching two support frames together.

18 Claims, 5 Drawing Sheets

ADJUSTABLE ROOF SUPPORT FRAME

BACKGROUND OF THE INVENTION

1. Field of Invention

This invention relates to an adjustable roof support frame that may be used to support roofs with access holes.

2. Description of Related Art

Buildings, especially commercial buildings, are often required to have roof access holes to allow various objects and structures, such as heating, air conditioning, and ventilation ducts, electrical cables, pipes, skylights, and smoke stacks, to pass through their roofs. However, once a hole is cut into a roof, it is necessary to provide additional structural support around the hole. If no additional support is provided, the roof may be damaged or weakened when a load is applied to the roof.

Roof support frames have been developed to provide additional structural support to roofs with access holes. In general, support frames surround an access hole and transmit loads to adjacent trusses joists. However, support frames have been relatively expensive to manufacture and install. The requirements of each building and the dimensions of each access hole are different. Consequently, support frames have been custom designed and manufactured for each site. What has long been needed is a means by which one roof support may be adapted to be used in different situations and to fit access holes of many different sizes.

The design of most prior art roof support frames also requires the frames to be assembled in an off-site manufacturing facility. Many support frames are welded together then shipped to building sites and installed. However, the assembled frames are bulky, requiring a great deal of space, which significantly increase the shipping and handling costs. What has long been needed is a support frame that may be shipped unassembled and then easily assembled at a building site. This would reduce shipping and handling costs by allowing a greater number of frames to be shipped in the same space.

SUMMARY OF THE INVENTION

The deficiencies of the past are overcome by the present invention which provides a support frame for supporting roofs. In particular, the roof support frame of the present invention includes an adjustable roof support frame that may be used with a variety of different roofs. The adjustable roof support frame of the present invention can be advantageously used to support roofs having access holes of any of a variety of sizes. That is, the roof support frame can be adjusted to support the roof in a vicinity of an access hole of a particular size in a complimentary manner.

The roof support frame of the present invention also has cost savings advantages over the roof support frames of the past. Since all of the pieces are pre-fabricated, the instant invention advantageously avoids the need for fabrication steps of cutting or welding. Thus, the pieces can be mass produced. The needed pieces can be shipped unassembled as a compact package. The support frame can be assembled on site and adjusted to the desired size for installation. Furthermore, the individual supports of the support frame can be adjusted and fixed at desired lengths by fasteners that do not require special tools. Hence the overall frame and installation are typically less expensive than past roof support frames.

In one aspect, the roof support frame of the present invention advantageously has hooks for supporting lateral supports on roof trusses that the support frame spans. These hooks facilitate adjustment and assembly since the hooks support the lateral supports at the desired length while the fasteners are tightened. Alternatively, the hooks may be replaced by truss bridge members to interconnect the roof support frame to another roof support frame on an opposite side of one of the trusses. That is, a truss bridge member can be substituted for a hook, span a truss, and support a first lateral support of a first roof support frame and a first lateral support member of a second roof support frame on a truss that runs between the frames.

Other deficiencies of the past are also overcome as can be appreciated by a review of the descriptions and drawings set forth below.

BRIEF DESCRIPTION OF THE INVENTION

The present invention comprises an adjustable roof support frame. The support frame comprises a first and a second lateral support and a first and a second cross support. The lateral supports and cross supports are attached together to form a substantially square or rectangular frame. Alternatively, other quadrilateral shapes may also be implemented.

Each lateral support comprises a first and second member that are adapted to be attached to each other. The second member comprises a substantially C-shaped cross section with a longitudinal channel. The channel is adapted to slidably receive the first member so that the inner top, side, and bottom surfaces of the channel abut the external top, side, and bottom surfaces of the first member, respectively. The overall length of the lateral supports may be adjusted by sliding the first member inside the channel of the second member. The first member may also have a C-shaped cross section with a longitudinal channel for increasing the rigidity of the member.

While C-shaped cross sections for the first and second members are preferred, other cross sections are also considered to be within the scope of the present invention. For example and not by way of limitation, these shapes may include I, H, square, rectangular, or solid beams.

Each member may comprise at least one fastener slot for receiving a fastener. When the first member is inside the channel of the second member, the fastener slots are aligned and a fastener can be inserted through the slots to attach the two members together. The fasteners are preferably standard nuts and bolts.

The cross supports are substantially similar to the lateral supports, having a first and second member. The second member has a substantially C-shaped cross section with a longitudinal channel. The second member slidably receives the first member within the longitudinal channel. Both the first and second members have at least one fastener slot for receiving a fastener.

The cross supports are attached to the lateral supports using joiners, preferrably in the form of L-brackets. The L-brackets abut the surfaces of the lateral supports and the cross supports. Fastener holes may be provided in the L-bracket to receive fasteners. When the cross supports are attached to the lateral supports, a square or rectangular hole is formed in the center of the frame. Objects and structures may be inserted through the hole to extend above or below the roof.

A truss hook is provided for attaching the support frame to trusses. In the preferred embodiment, one truss hook is attached to each end of each lateral support. The truss hook comprises a substantially T-shaped cross section with horizontal and vertical members. The horizontal and vertical members abut the upper and side surfaces of the lateral supports, respectively. The vertical member of the truss hook may comprise a fastener hole for attaching the truss hook to a lateral support. The end of the truss hook may have a hook for hooking the side of a truss.

The truss hook of the present invention may also be provided in the form of a truss bridge member that is adapted to span a truss and connect two support frames. The ends of the truss bridge member may have a substantially T-shaped cross section with horizontal and vertical members. The horizontal and vertical members abut the upper and side surfaces of the lateral supports of the support frames. Fastener holes may be provided in the vertical surface for receiving fasteners and attaching the lateral supports. The central portion of the truss bridge member is substantially horizontal with a small vertical height and is adapted to rest on a truss.

In another aspect, the invention is a kit for forming the adjustable roof support frame. The kit would generally include a minimum number of components. Typically the number of components would include enough pieces to complete at least one quadrilateral roof support frame. For example, a kit may include at least first and second lateral supports each comprising a first lateral member and a second lateral member having at least one slot adapted to adjustably connect the first lateral member to the second lateral member to provide a selected length for each lateral support. The kit also includes at least first and second cross supports each comprising a first cross member and a second cross member having at least one slot adapted to adjustably connect the first cross member to the second cross member to provide a selected length for each of the cross supports. In order to connect the cross supports to the lateral supports, the kit has at least four joiners. The support frame kit further includes at least four truss hooks for connection at the ends of the lateral supports. A plurality of appropriate fasteners is also included for interconnecting the supports, joiners, and truss hooks.

The above description sets forth, rather broadly, the more important features of the present invention so that the detailed description of the preferred embodiment which follows may be better understood and contributions of the present invention to the art may be better appreciated. There are, of course, additional features of the invention that will be described below and which will form the subject matter of claims. In this respect, before explaining at least one preferred embodiment of the invention in detail, it is to be understood that the invention is not limited in its application to the details of the construction and to the arrangement of the components set forth in the following description or as illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF DRAWINGS

The preferred exemplary embodiment of the present invention will hereinafter be described in conjunction with the appended drawings, where like designations denote like elements.

REFERENCE NUMERALS

Figure 1:
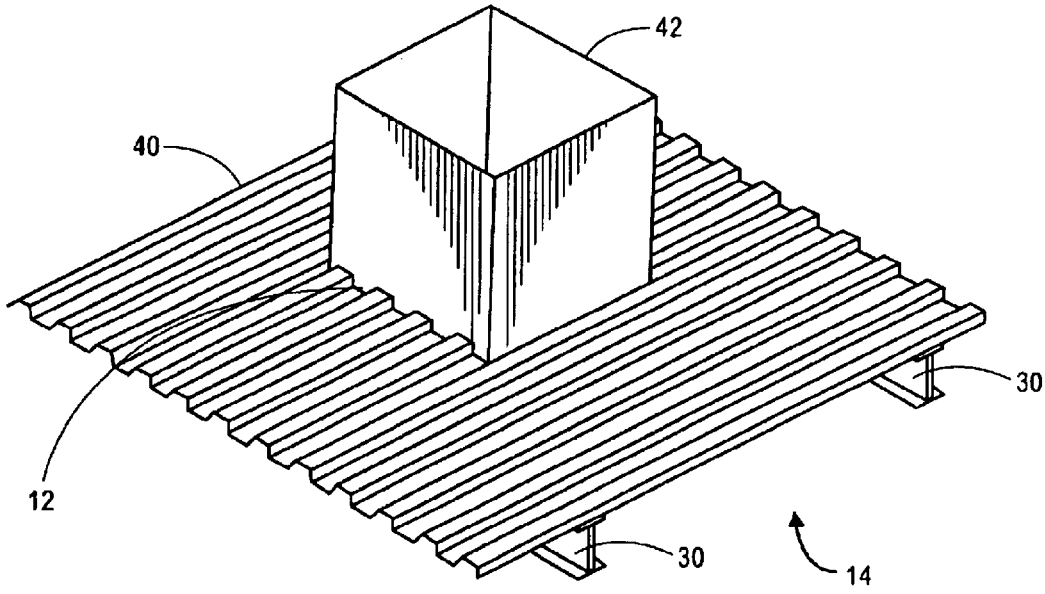
FIG. 1 is substantially an isometric view of a roof with a structure protruding through an access hole.

10 frame
12 access hole
14 roof
16 lateral supports
17 cross supports
18 brackets
20 first member
22 second member
23 longitudinal channel
24 fasteners
25 fastener slot
26 truss hook
30 truss or joist
32 horizontal member
33 truss hook
34 vertical member
40 roof material
42 structure
44 truss bridge member
50 package

DESCRIPTION OF THE PREFERRED EMBODIMENT

As seen in FIG. 1, the present invention may be used with a standard roof 14 having trusses or joists 30 and a structure 42 projecting out of access hole 12. Structure 42 may be any of a large number of objects or devices that are used on rooftops. For example, structure 42 may be a heating, air conditioning, or ventilation duct, a smokestack, electrical cables and wires, pipes, or a skylight. Roof 14 may be constructed using various materials that are well known in the art. For example, roof material 40 may be corrugated metal. Similarly, trusses 30 may be I-beams.

Figure 2:
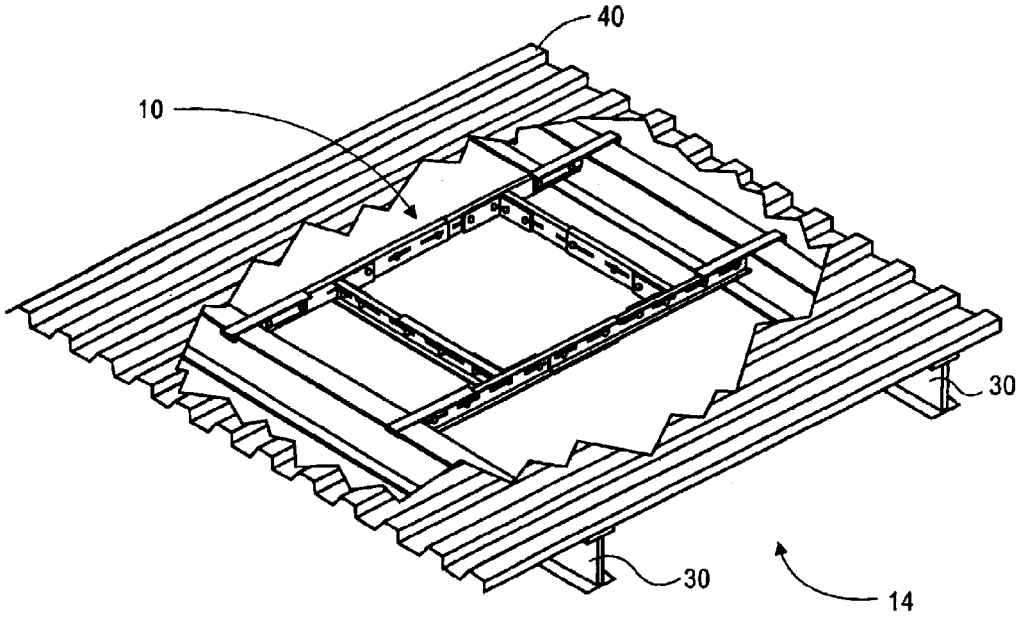
FIG. 2 is substantially an isometric cutaway view of a roof with the support frame of the present invention.

As seen in FIG. 2, the roof support frame of the present invention, generally indicated by reference number 10 is attached to trusses 30 underneath roof material 40. Frame 10 is adapted to span the space between trusses 30, so as to provide structural support to the roof across the entire space between the trusses. Preferably, the present invention is fashioned from heavy gauge steel. However, other substances, such as aluminum or iron may also be used.

Figure 3:
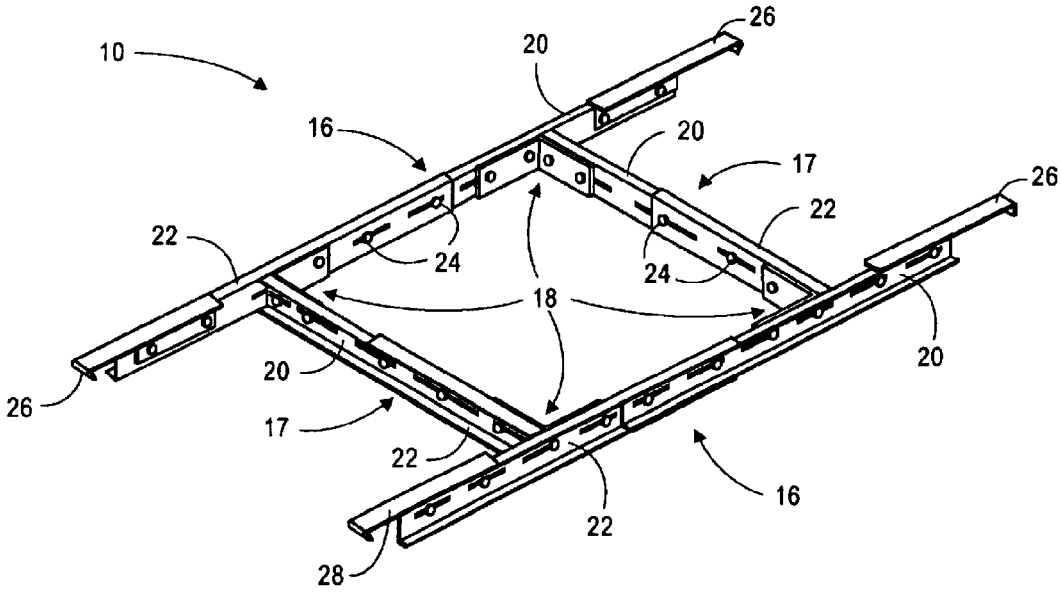
FIG. 3 is substantially an isometric view of the roof support frame of the present invention.
Figure 4:
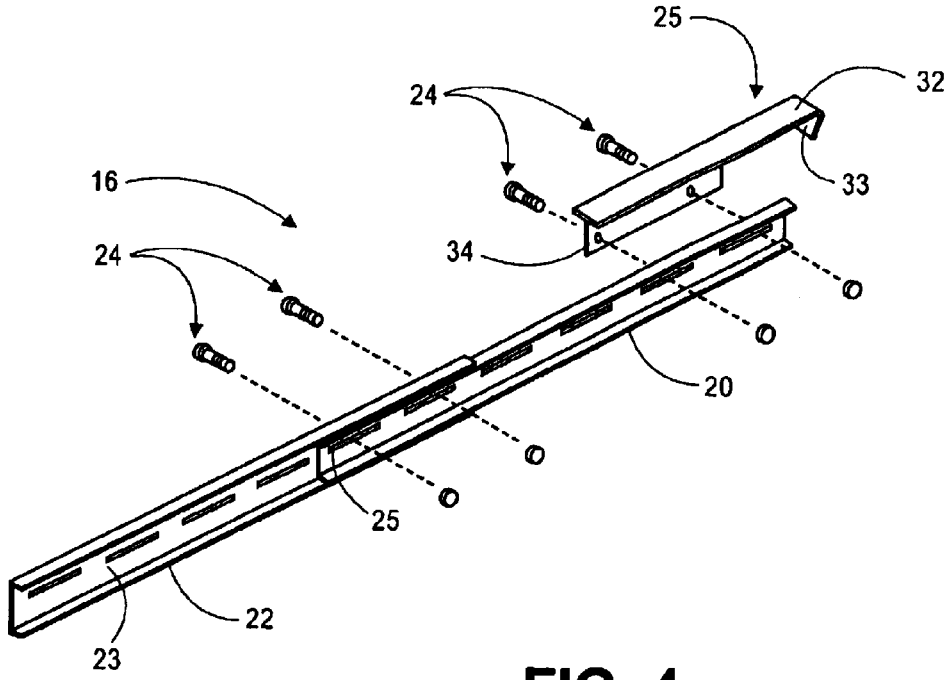
FIG. 4 is substantially an isometric partially exploded view of the lateral supports of the present invention.
Figure 5:
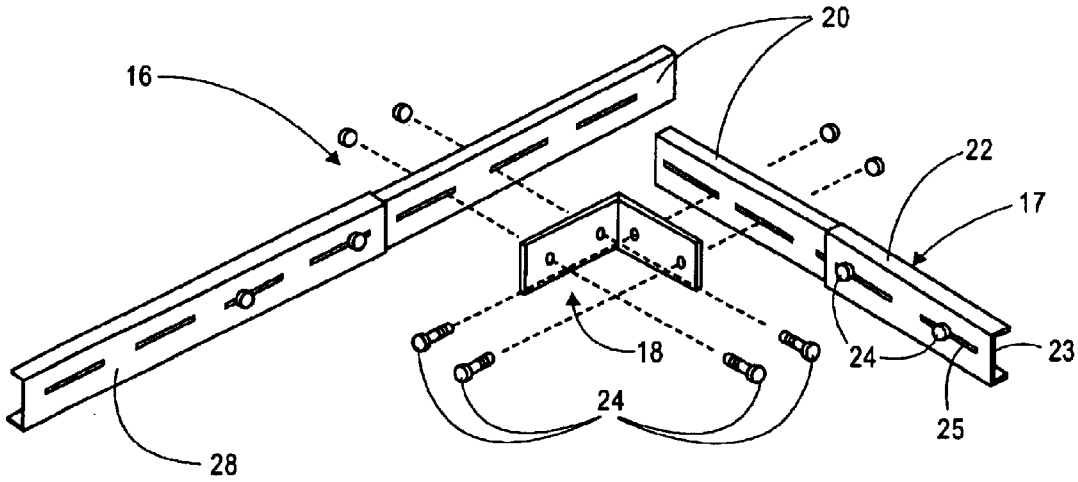
FIG. 5 is substantially an isometric exploded view of the lateral and cross supports of the present invention.

As seen in FIGS. 3–5, frame 10 comprises lateral supports 16, cross supports 17, and truss hooks 26. Lateral supports 16 comprise at least a first member 20 and a second member 22. Although not preferred, each lateral support may comprise more than two members. Preferably, second member 22 comprises a substantially C-shaped cross section with a longitudinal channel 23. Longitudinal channel 23 allows second member 22 to slidably receive first member 20 within the channel. The upper, side, and lower surfaces of channel 23 abut the upper, side and lower surfaces of first member 20. The abutting surfaces provide structural strength and rigidity. Preferably, first member 20 also comprises a substantially C-shaped cross section. This shape provides a high strength to weight ratio.

First member 20 and second member 22 comprise at least one fastener slot 25 for receiving a fastener. When first member 20 is inserted into channel 23 of second member 22, fastener slots 25 are aligned so that fasteners 24 may be inserted through both slots. Preferably, fasteners 24 comprise standard nuts and bolts.

The lateral support has a first end and a second end and a central portion in which the first and second members 20, 22 overlap each other. The overall length of lateral supports 16 can be adjusted by sliding first member 20 inside channel 23 of second member 22. This allows the length of lateral supports 16 to be adjusted to span different distances between trusses. Once a desired length is achieved, fasteners 24 are tightened to prevent relative motion between the members 20, 22.

The ends of each lateral support have respective truss hooks 26 attached thereon. Preferably, truss hook 26 comprises a substantially T-shaped cross section with a horizontal member 32 and a vertical member 34. Horizontal member 32 is adapted to abut the upper surface of lateral support 16 and the upper surface of truss 30 (see FIG. 2). Vertical member 34 is adapted to abut the vertical surface of lateral support 16 and may comprise one or more fastening holes for receiving fasteners 24. Truss hook 26 also comprises a hook 33 that is adapted to engage a truss on which support frame 10 is mounted. Truss hook 26 may comprise alternative attachment means, including by way of example and not by way of limitation, alternative holes for receiving fastening devices, channels for receiving portions of the members to which the hooks are to be fastened, studs, hooks, or clamping means.

The present invention is well adapted for use with corrugated roofs. Hook members 26 have a small vertical profile or height that allow them to be inserted in the channels of a corrugated roof material 40, between the roof material 40 and the trusses 30. Therefore, the present invention may be installed without removing sections of roof material 40 to expose trusses 30.

Support frame 10 also comprises cross supports 17 that are adapted to connect to lateral supports 16. Cross supports 17 are substantially similar to lateral supports 16, having a first member 20 and a second member 22. The second member 22 comprises a substantially C-shaped cross section with a longitudinal channel 23. Longitudinal channel 23 is adapted to slidably receive first member 20 and the internal upper, lower, and side surfaces of second member 22 abut the external upper, lower, and side surfaces of first member 20, respectively. First and second members 20 and 22 also comprise at least one fastener slot 25 for receiving a fastener 24.

The cross support has a first end and a second end and a central portion in which the first and second members 20, 22 overlap each other. The overall length of cross supports 17 may be adjusted by sliding first member 20 inside of channel 23 of second member 22. This allows the length of cross supports 17 to be adjusted to accommodate access holes or structures of different sizes.

Cross members 17 are attached to lateral support 16 by joiners 18. The joiners 18, preferrably in the form of brackets, may be L-brackets with surfaces for abutting the side surfaces of lateral supports 16 and cross supports 17. Fastener holes may be provided for receiving fasteners 24. Preferably, lateral support 16 and cross support 17 are fastened together so that the channels of the second members face outwards. This provides a large surface on each support upon which L-brackets 18 may abut.

Figure 6:
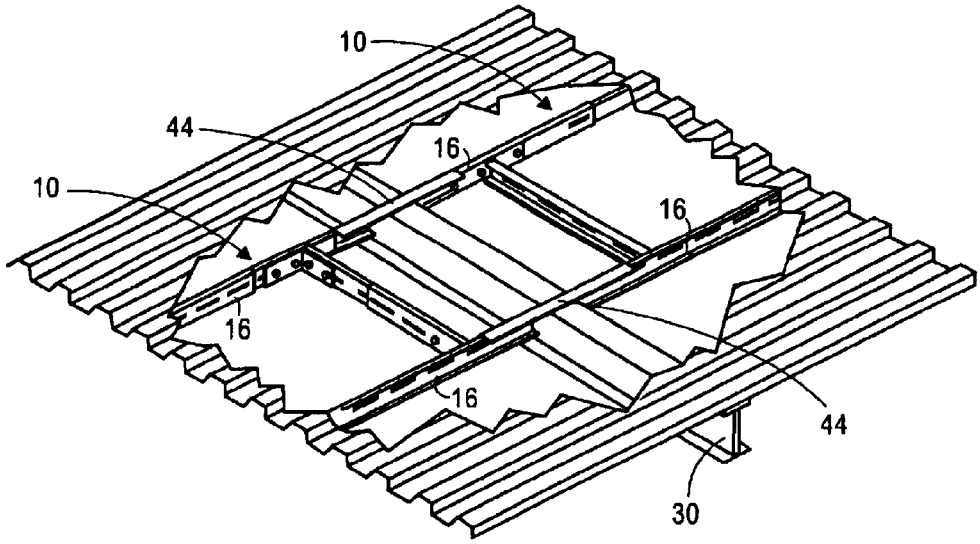
FIG. 6 is substantially an isometric cutaway view of a roof with two support frames of the present invention joined by truss bridge members.
Figure 7:
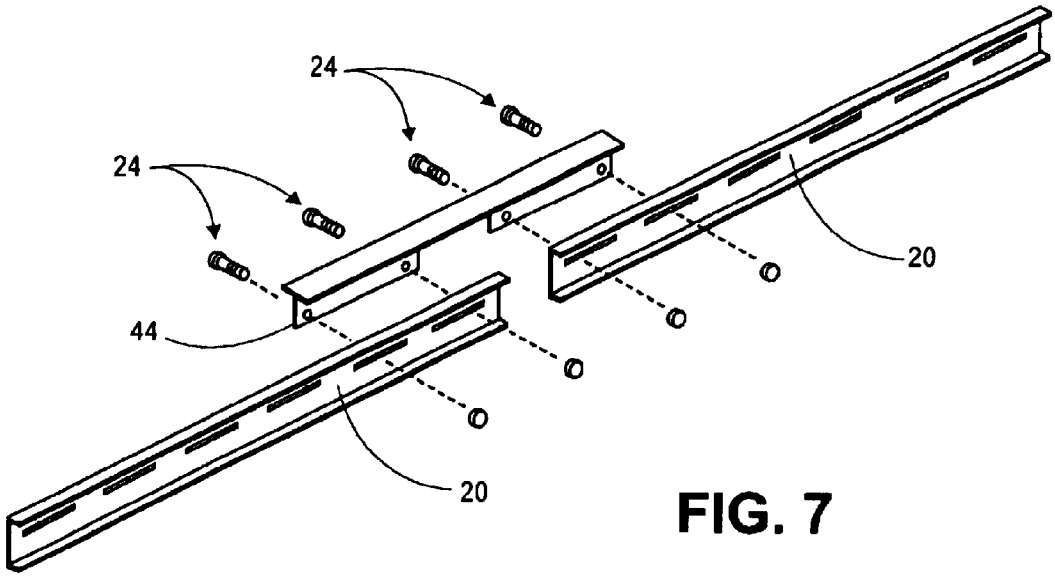
FIG. 7 is substantially an isometric partially exploded view of the truss bridge member of the present invention.
Figure 8:
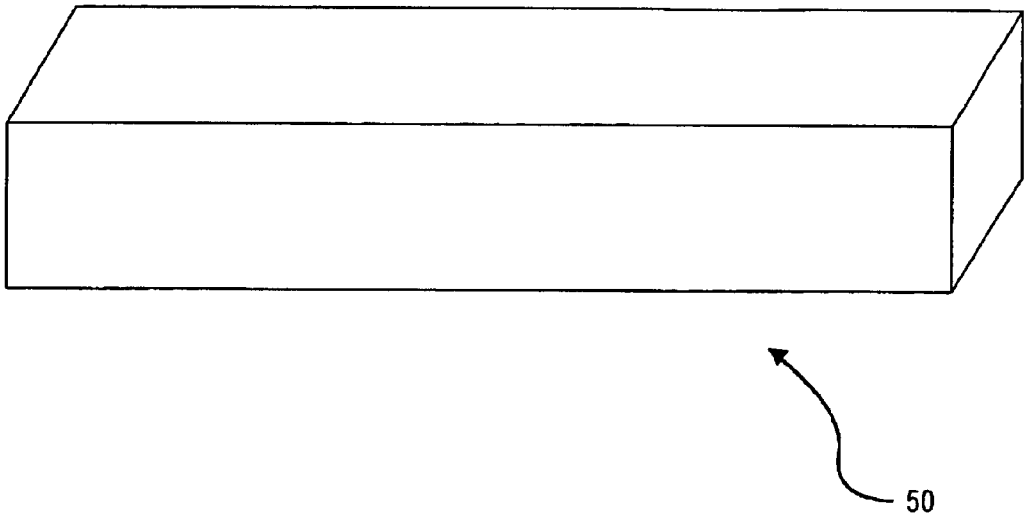
FIG. 8 is a perspective view of a compact package of the unassembled components of a kit of the present invention.

As seen in FIGS. 6 and 7, the present invention also comprises a means for connecting two support frames 10 over a truss 30. This may be accomplished using truss bridge members 44. The truss bridge members 44 are also truss hooks. The vertical contour of the truss bridge members 44 provides a low profile central bridge portion to rest upon and span the trusses.

Bridge end portions of the truss bridge members 44 comprises a substantially T-shaped cross-section with a greater vertical profile than the central bridge portion. The T-shaped ends have horizontal and vertical portions for abutting the horizontal and vertical surfaces of lateral supports 16. Preferably, fastener holes are provided on the vertical surfaces of truss bridge member 44 for receiving fasteners. The central portions of truss bridge members 44 are substantially horizontal with a small vertical height for resting on the truss 30. The truss bridge 44 rests on top of truss 30, and is attached to two lateral supports 16.

Another aspect of the invention is a method of using the adjustable roof support frame. The method of using includes adjusting a length of each of a first lateral support, a second lateral support, a first cross support, and a second cross support. The first and second lateral supports are positioned relative to the first truss and the second truss to support a predetermined region of the roof. Typically the first and second lateral supports are positioned in spaced relation to each other. In this relation, the lateral supports are connected at their ends to the first and second trusses. The step of connecting the lateral trusses preferrably includes fastening first and second truss hooks to respective ends of each lateral support. Once the truss hooks are fastened to the lateral supports, the hooks are rested on the first and second trusses. The method of using the roof support frame also includes positioning the first and second cross supports relative to the first and second lateral supports to support the predetermined region of the roof. Once the cross supports are in position, their ends are joined to the first and second lateral supports. In this way, the selected region of the roof that needs to be supported is generally surrounded by a quadrilateral frame of a selected size.

The method of using also includes the steps of individually adjusting the length of each of the lateral supports 16 and the cross supports 17 by slidably adjusting the first and second members 20, 22 relative to each other. In order to connect the lateral supports 16 to the trusses 30, the truss hooks are typically inserted between a sheet of roof material 40 and one of the trusses 30. In one case, at least some of the truss hooks are truss bridge members 44. The method employing the truss bridge members typically includes the step of fastening at least one truss bridge member to two lateral supports on opposite sides of a truss for interconnecting two roof support frames.

In another aspect, the invention is a kit for forming the adjustable roof support frame 10. The kit would generally include a minimum number of components. Typically the number of components would include enough pieces to complete at least one quadrilateral roof support frame. For example, a kit may include at least first and second lateral supports 16 each comprising a first lateral member 20 and a second lateral member 22 having at least one slot 25 adapted to adjustably connect the first lateral member to the second lateral member to provide a selected length for each lateral support 16. The kit also includes at least first and second cross supports 17 each comprising a first cross member 20 and a second cross member 22 having at least one slot 25 adapted to adjustably connect the first cross member 20 to the second cross member 22 to provide a selected length for each of the cross supports 17. It should be noted that the pairs of lateral members and cross members can be substantially similar to each other. In order to connect the cross supports 17 to the lateral supports 16, the kit has at least four joiners 18. The support frame kit further includes at least four truss hooks 33 for connection at the ends of the lateral supports 16. A plurality of appropriate fasteners 24 is also included for interconnecting the supports 16,17, joiners 18, and truss hooks 33.

The kit advantageously has the lateral members 20, 22, the cross members, 20, 22, the joiners 18, the hooks 33, and the fasteners 25 compactly packaged together in an unassembled state for shipping. As described above, each of the first and second members 20, 22 of each of the lateral support 16 and the cross support 17 can comprise respective first and second slots 25 having first and second lengths. As such, the adjustable length of each support may be varied by an amount approximately equal to a sum of the first and second lengths.

As can be appreciated from the above description, the present invention provides a useful and advantageous roof support frame. The support frame is highly adjustable, allowing the frame to be used with a large variety of buildings, structures, and access holes. The support frame may be shipped disassembled and assembled at a building site. The present invention may be used with new buildings or it may be used to retrofit existing buildings.

While the present invention has been described as incorporating slots in each of the inner and outer channel members and at least one fastener in the form of a standard bolt and nut extending through both slots to provide a slidably adjustable connection, other adjustment means are also considered to be within the scope of the present invention. By way of example and not by way of limitation, alternative adjustment means may include but are not limited to a hole in one member and a slot in the other, mating channels, mating slots and studs at discrete positions along the lengths of members comprising the supports. Furthermore, while the means for connecting the cross supports to the lateral supports is described above as comprising L-shaped brackets, it is considered that any of a variety of brackets or other joining means are also within the scope of the invention. For example, brackets of other shapes, mating studs and slots on the cross supports and lateral supports, or other structure for enabling joining by any of a variety of fasteners may be used to join the cross supports to the lateral supports.

Although the description above contains many specifications, these should not be construed as limiting the scope of the invention but as merely providing illustrations of some of presently preferred embodiments of this invention. Thus, the scope of the invention should be determined by the appended claims and their legal equivalents rather than by the examples given.

What is claimed is:

1. An adjustable roof support frame for supporting a roof having at least a first and a second truss, the adjustable roof support comprising:

(A) a first and a second lateral support each having:

(a) a first lateral end and a second lateral end;

(b) a first lateral member and a second lateral member at least partially overlapping the first lateral member in a central portion of the respective lateral support between the first lateral end and the second lateral end;

(c) at least one slot in one of the first and second lateral members and a through hole in the other of the first and second members; and (d) at least one fastener extending into the slot and the through hole and slidably connecting the first and second lateral members together;

(B) a plurality of hooks comprising:

(a) a first hook removably connected to the first lateral end and a second hook connected to the second lateral end of each lateral support; and (b) wherein each hook comprises a fastening portion supported on the lateral support and a hook portion extending away from the lateral support;

(C) a first and a second cross support, each cross support having:

(a) a first cross support end and a second cross support end;

(b) a first cross member and a second cross member at least partially overlapping the first cross member in a central portion of the respective cross support between the first cross support end and the second support end;

(c) at least one slot in one of the first and second cross members and a through hole in the other of the first and second cross members; and (d) at least one fastener extending into the slot and the through hole and slidably connecting the first and second cross members together;

(D) a plurality of joiners removably joining each of the first and second cross support ends to one of the lateral supports.

2. The frame of claim 1 further comprising:

(a) the second lateral member having at least one fastener slot and a substantially C-shaped cross section with a longitudinal channel, wherein said second member is adapted to slidably receive said first member in said channel;

(b) the first lateral member having at least one fastener slot;

(c) the first cross member having at least one fastener slot and a substantially C-shaped cross section with a longitudinal channel, wherein said second cross member is adapted to slidably receive said first member in said longitudinal channel;

(d) the first cross member having at least one fastener slot; and (e) at least one fastener for each of the lateral supports and the cross supports, wherein said fastener is adapted to be inserted through said slots of said first and second members to attach said first member to said second member.

3. The frame of claim 1 wherein said hook is elongate in a lateral direction and said hook portion has a low profile in a direction transverse to the lateral direction for easy insertion between a roofing material and one of the trusses.

4. The frame of claim 1 wherein the plurality of hooks comprises truss bridges, wherein the truss bridges each comprise:

(a) a central bridge portion for spanning a truss;

(b) first and second fastening end portions for fastening two lateral supports together;

(c) wherein the truss bridges have a vertical profile in the bridge portion less than a vertical profile in the first and second bridge end portions; and (d) wherein the truss bridges are adapted to hook the first or the second truss.

5. The frame of claim 1, wherein the first lateral member and the second lateral member of each of the lateral supports are longitudinally adjustable relative to each other in a lateral direction.

6. The frame of claim 1, wherein the first cross member and the second cross member of each of the cross supports are longitudinally adjustable relative to each other in a cross direction transverse to the lateral supports.

7. The frame of claim 1, further comprising:

(a) the joiners joining the first and second cross supports to the first and second lateral supports and forming a quadrilateral frame in which two sides of the frame are formed by the first and second lateral supports and two sides of the frame are formed by the first and second cross supports; and (b) wherein each side is adjustable in length by adjusting the members of a respective support.

8. The frame of claim 1, wherein:

(a) the slots have a first slot length; and (b) the through holes are also slots having a second slot length such that the adjustable length of each support may be varied by an amount approximately equal to a sum of the first and second lengths.

9. An adjustable roof support frame kit, comprising:

(A) at least first and second lateral supports;

(a) wherein the lateral supports each comprise a first lateral member and a second lateral member having at least one slot adapted to adjustably connect the first lateral member to the second lateral member to provide a selected length for each lateral support;

(B) at least first and second cross supports;

(a) wherein the cross supports each comprise a first cross member and a second cross member having at least one slot adapted to adjustably connect the first cross member to the second cross member to provide a selected length for each cross support;

(C) at least four joiners for joining the cross supports to the lateral supports;

(D) at least four truss hooks; and (E) a plurality of fasteners for interconnecting the supports, joiners, and truss hooks.

10. The kit of claim 9, the hooks further comprising:

(a) a fastening portion for connection with the lateral supports; and (b) a hook portion;

(c) wherein said hooks are elongate in a direction generally along a line from the fastening portion to the elongate portion; and (d) wherein the hook portion has a low profile in a direction transverse to said line for easy insertion between a roofing material and one of the trusses.

11. The kit of claim 9, wherein the hooks comprise truss bridges, wherein the truss bridges comprise (a) a central bridge portion for spanning a truss, (b) first and second fastening end portions for fastening two lateral supports together;

(c) wherein the truss bridges have a vertical profile in the bridge portion less than a vertical profile in the first and second bridge end portions; and (d) wherein the truss bridges are adapted to extend between a sheet of roofing material and a truss to hook the truss.

12. The kit of claim 9, further comprising:

(a) the lateral members, the cross members, the joiners, the hooks, and the fasteners compactly packaged together in an unassembled state for shipping;

(b) wherein the joiners are adapted for joining the first and second cross supports to the first and second lateral supports and for forming a quadrilateral frame in which two sides of the frame are formed by the first and second lateral supports and two sides of the frame are formed by the first and second cross supports; and (c) wherein the kit is adapted for forming the quadrilateral frame such that each of the sides of the frame is adjustable in length by adjusting the members of a respective support.

13. The kit of claim 9, wherein:

(a) each of the first and second members of each of the lateral supports and the cross supports comprises respective first and second slots having first and second lengths; and (b) wherein the adjustable length of each support may be varied by an amount approximately equal to a sum of the first and second lengths.

14. The kit of claim 13, further comprising:

(a) means for adjusting an d means for joining the lateral supports and the cross supports to form a roof support frame; and (b) means for positioning and means for connecting the lateral supports on trusses of a roof to generally surround a region of the roof to be supported.

15. A method of using an adjustable roof support frame for a roof having a first truss and a second truss, the method comprising:

(A) adjusting a length of a first lateral support;

(B) adjusting a length of a second lateral support;

(C) adjusting a length of a first cross support;

(D) adjusting a length of a second cross support;

(E) positioning the first lateral support relative to the first truss and the second truss to support a predetermined region of the roof, (F) positioning the second lateral support relative to the first truss and the second truss in spaced relation to the first lateral support to support the predetermined region of the roof;

(G) connecting a first end of the first lateral support to the first truss and a second end of the first lateral support to the second truss;

(H) connecting a first end of the second lateral support to the first truss and a second end of the second lateral truss to the second truss, wherein the steps of connecting the first and second ends of the first and second lateral supports to the first and second trusses further comprising:

(a) fastening first and second truss hooks to the first and second ends of each lateral support; and (b) resting the hooks on the first and second trusses;

(I) positioning the first cross support relative to the first lateral support and the second lateral support to support the predetermined region of the roof;

(J) positioning the second cross support relative to the first lateral support and the second lateral support in spaced relation to the first cross support to support the predetermined region of the roof, (K) joining a first end of the first cross support to the first lateral support and a second end of the first cross support to the second lateral support;

(L) joining a first end of the second cross support to the first lateral support and a second end of the second cross support truss to the second lateral support; and (M) thereby generally surrounding said region of the roof with a quadrilateral frame of a selected size for supporting the region between said trusses.

16. The method using of claim 15, wherein each of the lateral supports comprises at least two lateral members and each of the cross supports comprises at least two cross members, the steps of adjusting a length of each of the lateral supports and cross supports further comprising slidably adjusting one of the members relative to another of the members.

17. The method of using of claim 16, wherein at least some of the truss hooks are truss bridges, the method further comprising fastening at least one truss bridge to another lateral support on an opposite side of one of the trusses from the first and second lateral supports.

18. The method of using of claim 15, wherein steps of connecting the first and second ends of the first and second lateral supports to the first and second trusses further comprises inserting truss hooks between a sheet of roofing material and the trusses.

* * * * *